US005080493A

United States Patent [19]

McKown et al.

[11] Patent Number: 5,080,493

[45] Date of Patent: Jan. 14, 1992

[54] STATIC MIXING ASSEMBLY

[75] Inventors: Alan G. McKown; Philip W. Claybourne; Robert J. Mariana, all of St. Paul, Minn.

[73] Assignee: Minnesota Mining and Manufacturing Company, St. Paul, Minn.

[21] Appl. No.: 650,440

[22] Filed: Feb. 4, 1991

Related U.S. Application Data

[63] Continuation-in-part of Ser. No. 483,238, Feb. 22, 1990, abandoned.

[30] Foreign Application Priority Data

Dec. 19, 1990 [EP] European Pat. Off. ..... 90313874

[51] Int. Cl.[5] ..... B01F 15/02

[52] U.S. Cl. ..... 366/177; 222/136; 222/459; 222/496; 366/339

[58] Field of Search ..... 366/150, 176, 177, 183, 366/336, 337, 338, 339, 340, 341; 222/459, 496, 136, 137, 334

[56] References Cited

U.S. PATENT DOCUMENTS

| | | | |
|---|---|---|---|
| 1,688,571 | 10/1928 | Zerk . | |
| 1,896,729 | 2/1933 | Jakubec . | |
| 1,955,029 | 4/1934 | Smallhouse | 221/84 |
| 2,755,003 | 7/1956 | Sherbondy | 222/327 |
| 3,159,312 | 12/1964 | Van Sciver II | 222/137 |
| 3,286,992 | 11/1966 | Armeniades | 366/339 |
| 3,405,845 | 10/1968 | Cook et al. | 222/387 |
| 4,260,077 | 4/1981 | Schroeder | 222/137 |
| 4,538,920 | 9/1985 | Drake | 366/177 |
| 4,634,027 | 1/1987 | Kanarvogel | 222/380 |
| 4,648,421 | 3/1987 | Chant et al. | 137/312 |
| 4,747,522 | 5/1988 | McIntyre | 222/213 |
| 4,753,536 | 6/1988 | Spehar et al. | 366/339 |
| 4,834,545 | 5/1989 | Inoue et al. | 366/138 |
| 4,838,324 | 6/1989 | Boyd | 141/64 |
| 4,930,689 | 6/1990 | Stumpf | 222/487 |
| 4,995,540 | 2/1991 | Colin | 222/459 |

FOREIGN PATENT DOCUMENTS 2019952 11/1979 United Kingdom .

*Primary Examiner*—Robert W. Jenkins

*Attorney, Agent, or Firm*—Gary L. Griswold; Walter N. Kirn; James D. Christoff

[57] ABSTRACT

An assembly for mixing two different liquid components includes a container having two barrels, and an exit conduit detachably connected to the container. The exit conduit includes a static mixer along with a check valve located between the static mixer and an outlet of the exit conduit. The check valve prevents the dripping of mixed materials from the exit conduit between intended dispensing operations, and may be discarded along with the exit conduit after extended interruptions between dispensing operations.

8 Claims, 1 Drawing Sheet

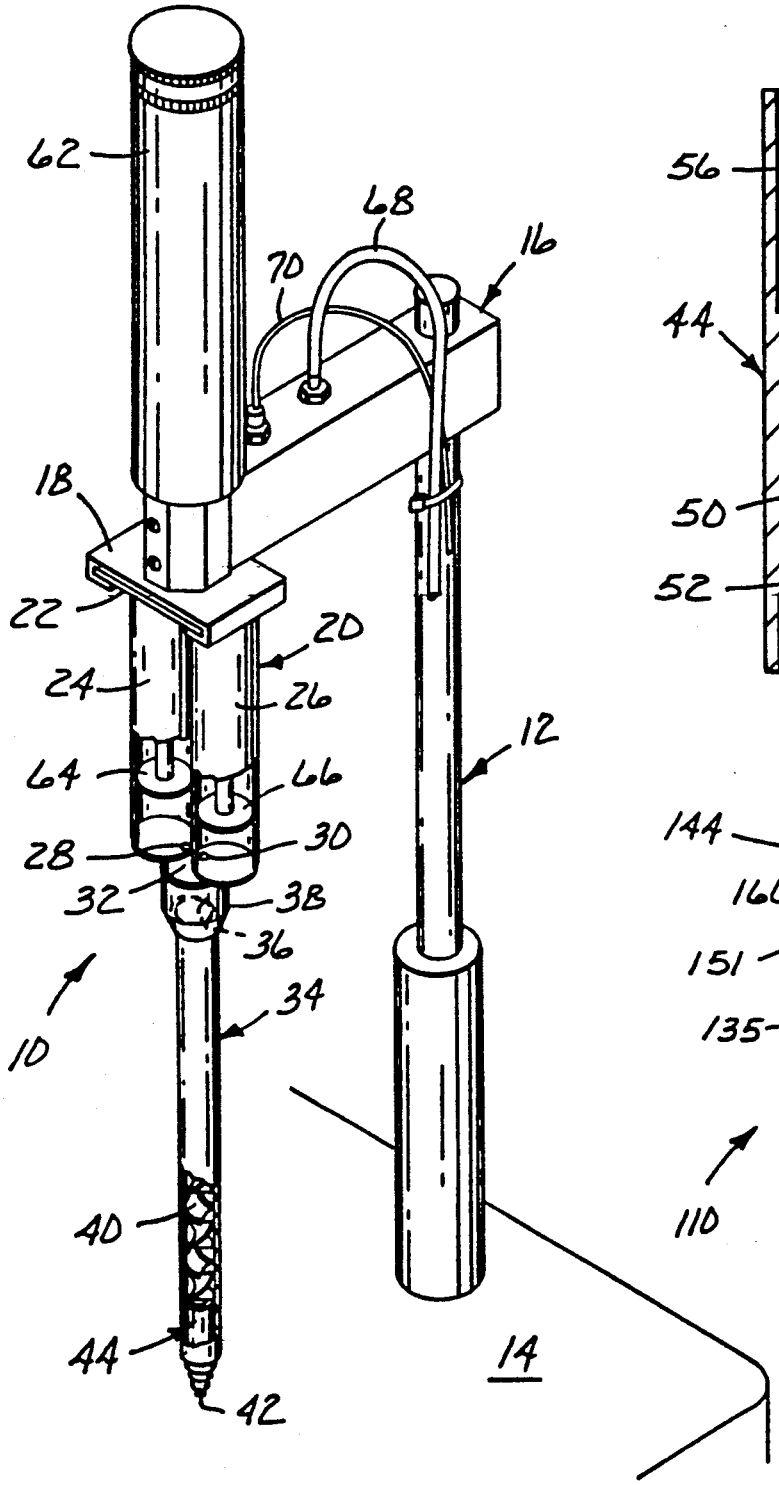
Fig. 1
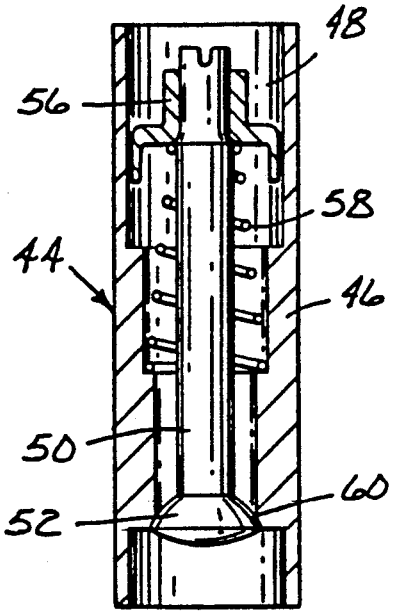
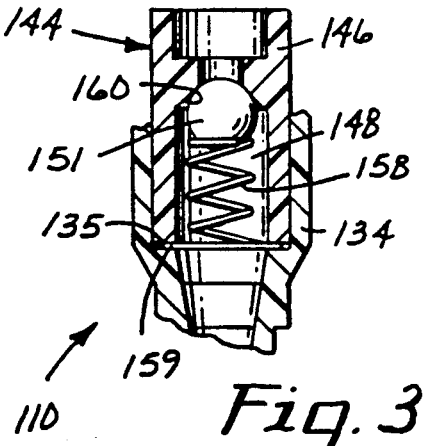
Fig. 3

STATIC MIXING ASSEMBLY

This application is a continuation-in-part of application Ser. No. 07/483,238, filed Feb. 22, 1990 now abandoned.

BACKGROUND OF THE INVENTION

1. Field of the Invention

This invention relates to an assembly for mixing and dispensing two liquid components.

2. Description of the Related Art

Static mixing assemblies are in widespread use for storing, mixing and dispensing two liquid components such as two-part curable resins. For example, U.S. Pat. No. 4,538,920 illustrates a syringe having side-by-side barrels for storing different liquid materials, and the syringe includes a detachable exit conduit having a static mixer located downstream of the barrels. As a piston assembly is advanced in the syringe shown in U.S. Pat. No. 4,538,920, liquid materials discharged from the barrels are mixed in the static mixer and dispensed through an outlet of the exit conduit.

A troublesome problem that has been noted in connection with dispensing of certain material from static mixer assemblies is the drippage or drooling of the materials from the exit conduit after the intended end of a dispensing operation. Users of hand-held static mixer assemblies may remove the assembly from the work area to avoid dripping additional mixed materials on the workpiece and place the end of the exit conduit over a disposable cup to catch drips. However, such a procedure represents an annoyance and a waste of materials. Some users have attempted to pull back the handles of the pistons in an attempt to avoid such problems, but it is often observed that relief of pressure in the barrels does not completely stop the drooling of material from the end of the static mixer.

The problem of dripping from static mixers is particularly noticeable when the mixer is part of a stationary dispensing assembly that has an upright orientation. Stationary mixers are often used in automated manufacturing processes, and in these instances care must be taken to insure that the workpiece does not remain beneath the outlet of the static mixer once sufficient amounts of mixed materials have been dispensed. Again such drippage represents a nuisance and an expense that would preferably be avoided.

SUMMARY OF THE INVENTION

The present invention relates to a static mixing assembly that comprises a container having a first barrel with an exit port, and a second barrel with an exit port. The assembly includes a first piston movable in the first barrel and a second piston movable in the second barrel simultaneously with movement of the first piston, for ejection of materials from the first and second barrels through respective exit ports. The assembly further has an exit conduit with an inlet end, an outlet and means for detachably connecting the inlet end to the exit ports of the first and second barrels. The conduit includes a static mixer located between the inlet end and the outlet for mixing materials ejected from the first and second barrels. Advantageously, the conduit includes a check valve located between the static mixer and the outlet for substantially preventing drippage of mixed materials from the outlet after movement of the pistons has ceased. As such, the check valve may be discarded with the exit conduit once the exit conduit is detached from the exit ports.

BRIEF DESCRIPTION OF THE DRAWINGS

FIG. 1 is a top, right and front side perspective view of an assembly according to the invention with parts broken away in section;

FIG. 2 is an enlarged, front, vertical sectional view of a check valve of the assembly shown in FIG. 1; and FIG. 3 is an enlarged, front, vertical sectional view of a check valve of an assembly according to another embodiment of the invention.

DETAILED DESCRIPTION OF THE PREFERRED EMBODIMENTS

A static mixing assembly 10 is illustrated in FIG. 1 and includes an upright support 12 that is secured to a workpiece-holding table 14. A horizontally-extending arm 16 is fixed to an upper portion of the support 12. A generally C-shaped holder 18 is connected to an outer end of the arm 16 remote from the support 12.

The assembly 10 also includes a container 20 that has a rectangular flange 22 which slidably fits into the holder 18. The container 20 includes a first elongated, cylindrical barrel 24 and a second elongated, cylindrical barrel 26 that is integrally molded with the first barrel 24 in side-by-side, parallel relationship. The container 20 is made of a synthetic resinous material, and is normally supplied to the end user with different liquid components in the barrels 24, 26. The slidable interconnection between the flange 22 and the holder 18 enables the user to dispose of the container 20 once the barrels 24, 26 are emptied, and thereafter install another container in the holder 18.

The first barrel 24 has an exit port 28 adjacent its lower end, and the second barrel 26 has an exit port 30 adjacent its lower end. Both of the ports 28, 30 communicate with separated, juxtaposed channels (not shown) formed within a cylindrical, depending, threaded neck 32 of the container 20.

The assembly 10 further includes an elongated, tubular exit conduit 34 with an upper frustoconical inlet end 36. A means for detachably connecting the inlet end 36 to the neck 32 of the container 20 comprises a collar 38 having internal threads that mate with the threads of the neck 32. The collar 38 is loose and, when rotated relative to the exit conduit 34 while engaging the threaded neck 32, fixes the inlet end 36 against the bottom of the neck 32. Rotation of the collar 38 in the opposite direction enables the collar 38 along with the exit conduit 34 to be detached from the container 20 when desired.

A static mixer 40 is positioned within the exit conduit 34 between the inlet end 36 and a lower outlet 42 of the conduit 34. The static mixer 40 comprises a sequence of oppositely oriented mixing blades such as are described in the aforementioned U.S. Pat. No. 4,538,920, the disclosure of which is incorporated by reference herein. As shown in FIG. 1, the exit conduit 34 also carries a check valve 44 which is located between the static mixer 40 and the outlet 42.

The check valve 44 is shown in more detail in FIG. 2 and includes a housing 46 having an upper end that contacts the lower end of the static mixer 40, and a lower end that is retained in place by a necked-down wall that forms the outlet 42. The housing 46 has an internal passageway 48 which receives a valve stem 50 having a head 52. The upper end of the stem 50 is secured to a bracket 56 that, in turn, retains a coiled compression spring 58 in place within the passageway 48 and around the stem 50. The lower end of the spring 58 rests against a shoulder formed in the housing 46, and biases the stem upwardly such that the head 52 is urged toward a position of sealing contact with a valve seat 60 formed in the housing 46.

Referring again to FIG. 1, a dual-acting piston and cylinder assembly 62 is mounted atop the arm 16 and is connected by shafts to a first piston 64 and a second piston 66 that moves simultaneously with movement of the first piston 64. As air pressure is introduced to the top of the piston and cylinder assembly 62 via tubing 68, the piston of the assembly 62 descends and causes the first and second pistons 64, 66 to move downwardly at the same time in the respective barrels 24, 26.

Each of the barrels 24, 26 is adapted to contain different liquid components. As the pistons 64, 66 descend, a portion of the liquid components are discharged through the ports 28, 30, through neck 32 and into the inlet end 36 of the exit conduit 34. As the pistons 64, 66 continue to move downwardly, the components are admixed during movement through the conduit 34 and arrive at the check valve 44 in a thoroughly mixed condition.

As long as pressure is exerted by the pistons 64, 66 on the liquid materials within the barrels 24, 26, the materials will flow through the exit conduit 34 and enter the passageway 48 of the check valve 44. As a result, pressure of the descending, mixed liquids is exerted on the stem 50 which shifts longitudinally in a downwardly direction against the bias presented by the spring 58 to unseat the head 52 and enable the mixed liquid materials to flow past the check valve 44 and through the outlet 42 toward a workpiece or other object.

Once air pressure on the tubing 68 is relieved, pressure of the pistons 64, 66 on the liquid materials within the barrels 24, 26 is also relieved which in turn decreases the pressure of liquid materials in the vicinity of the static mixer 40. At such time, the spring 58, in contact with the bracket 56, pushes the stem 50 upwardly to close the check valve 44 by engaging the top of the head 52 against the valve seat 60. Consequently, the check valve 44 substantially prevents unintentional drippage of the mixed materials from the exit conduit 34 once pressure is no longer exerted by the pistons 64, 66.

Typically, only a portion of the liquid materials within the barrels 24, 26 is discharged into the exit conduit 34 at the end of a day's operation or other, relatively long work interruption. In such situations, the mixed components within the conduit 34 will cure or harden to such a condition that subsequent ejection of mixed materials through the outlet 42 is substantially difficult if not impossible. Consequently, it is desirable for the user to discard the filled exit conduit 34 by rotation of the collar 38 until the conduit 34 is completely separated from the container 20. At that time, the user may simply install a new exit conduit in its place.

Importantly, the check valve 44 is carried within the conduit 34 and thus does not have to be cleaned at the end of a dispensing operation. Instead, the check valve 44, being of relatively inexpensive construction, can simply be discarded along with remaining components of the exit conduit 34 as soon as the liquid materials therein have hardened to such a condition that further discharge of the latter through the outlet 42 is rendered difficult.

Once the liquid materials within the barrels 24, 26 are exhausted, air pressure may be directed through a second tube 70 which is connected to a lower portion of the piston and cylinder assembly 62 in order to force the piston of the latter in an upwardly direction, thereby raising the pistons 64, 66 out of the container 20. The user may then detach the container 20 from the arm 16 by sliding the flange 22 out of the holder 18.

A presently preferred embodiment of the invention is shown in FIG. 3 and includes a check valve 144 that is received in a lower end of a disposable, detachable exit conduit 134 of a static mixing assembly 110. The assembly 110 with the exception of the check valve 144 is similar to the assembly 10 described in connection with FIGS. 1 and 2.

The check valve 144 includes a cylindrical plastic housing 146 having an internal, central, longitudinal passageway 148. A spherical valve ball 151 located in the passageway 148 is urged by a compression spring 158 toward a conical valve seat 160 formed in the housing 146. The major extent of the spring 158 is of a constant outer diameter smaller than the internal diameter of adjacent portions of the passageway 148, but a lowermost end coil 159 of the spring 158 is larger than the internal diameter of the passageway 148.

During construction of the static mixing assembly 110, the check valve 144 is inserted into the entrance of the exit conduit 134 with the end coil 159 protruding in front of the housing 146. The check valve 144 is advanced toward the outlet of the exit conduit 134 until one side of the end coil 159 engaged a radial shoulder 135 formed in the housing 146 while the forward end of the housing 146 is in contact with the opposite side of the end coil 159. In this manner, the spring 158 is captured and a separate fastener or the like is not needed.

The check valve 144 is believed to provide higher flow rates of material through the passageway 148 in comparison to the check valve 44 for a given amount of pressure exerted on the material. Moreover, it is believed that the check valve 144 provides a faster, more positive shut-off of materials flowing through the exit conduit 134 than the check valve 44. Also noteworthy is the reduced overall length of the check valve 144 in comparison to the check valve 44, which enables a greater length of static mixer (such as mixer 40) to be received in a given length of exit conduit 134.

In either of the embodiments, the check valve 44, 144 is advantageous because it is constructed in cartridge-like fashion and can be used with conventional exit conduits without fasteners. Generally, the snugness of fit between the static mixer and the exit conduit is sufficient to hold both the static mixer and the check valve in place in the exit conduit even, when the exit conduit is inverted from the position shown in the drawings.

We claim:

1. A static mixing assembly comprising:

a container having a first barrel with an exit port, and a second barrel with an exit port;

a first piston movable in said first barrel and a second piston movable in said second barrel simultaneously with movement of said first piston, for ejection of materials from said first and second barrels through respective exit ports; and an exit conduit having an inlet end, an outlet, and means for detachably connecting said inlet end to said exit ports of said first and said second barrels, said conduit including a static mixer located between said inlet end and said outlet for mixing materials ejected from said first and said second barrels, said conduit including a check valve located between said static mixer and said outlet for substantially preventing drippage of mixed materials from said outlet after movement of said pistons has ceased, whereby said check valve may be discarded with said exit conduit once said exit conduit is detached from said exit ports.

2. The assembly of claim 1, wherein said check valve includes a housing releasably inserted in said exit conduit.

3. The assembly of claim 2, wherein said housing is held in place by an interference fit.

4. The assembly of claim 3, wherein said interference fit is established between said static mixer and said exit conduit.

5. The assembly of claim 2, wherein said housing has a passageway, and wherein said check valve includes a spring having a portion larger than said passageway.

6. The assembly of claim 5, wherein said portion of said spring is captured between said housing and said exit conduit.

7. The assembly of claim 1, wherein said exit conduit has a necked-down wall forming said outlet, and wherein said check valve includes a housing at least partially held in place by said wall.

8. The assembly of claim 1, wherein said check valve includes a stem, a housing having a passageway, and a spring biasing the stem toward a position to close the passageway.

* * * * *